US006447325B1

(12) United States Patent
Yamane et al.

(10) Patent No.: US 6,447,325 B1
(45) Date of Patent: Sep. 10, 2002

(54) CONNECTION STRUCTURE FOR ELECTRIC WIRES

(75) Inventors: Shigeki Yamane, Nagoya (JP); Takahiro Onizuka, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/518,271

(22) Filed: Mar. 3, 2000

(30) Foreign Application Priority Data

Jun. 23, 1999 (JP) ..... 11-176824

(51) Int. Cl.[7] ..... H01R 4/24
(52) U.S. Cl. ..... 439/404; 493/402
(58) Field of Search ..... 439/404, 402, 439/507, 949, 408

(56) References Cited

U.S. PATENT DOCUMENTS 4,938,719 A * 7/1990 Sawai et al. ..... 439/714
5,000,699 A * 3/1991 Nadin ..... 439/511
5,207,587 A * 5/1993 Hamill et al. ..... 439/76
5,372,521 A * 12/1994 Laudereau ..... 439/507
5,498,172 A * 3/1996 Noda ..... 439/404
5,501,605 A * 3/1996 Ozaki et al. ..... 439/34
5,567,173 A * 10/1996 Franckx ..... 439/418
5,782,651 A * 7/1998 Konoya ..... 439/405
5,888,088 A * 3/1999 Kobayashi et al. ..... 439/404
5,888,089 A * 3/1999 Konoya et al. ..... 439/404
5,934,929 A * 8/1999 Saka et al. ..... 439/404
6,220,874 B1 * 4/2001 Kurata et al. ..... 439/76.2

FOREIGN PATENT DOCUMENTS

FR 0 470 887 A1 * 7/1992
JP 60-35911 * 2/1985
JP 6-275346 * 6/1994

* cited by examiner

*Primary Examiner*—Brian Sircus
*Assistant Examiner*—Thanh-Tam Le
(74) *Attorney, Agent, or Firm*—Oliff & Berridge, PLC

(57) ABSTRACT

A common insulating plate 16 is prepared such that a plurality of paired upper and lower electric wire fitting grooves 16*b* and 16*d* are formed straight in the insulating plate 16 at a constant pitch P1 in the transverse direction, and such that a plurality of press-fitting slits 16*e* are formed in the individual electric wire fitting grooves 16*a* and 16*c* at a constant pitch P2 in the longitudinal direction; compression relay terminals 17 are press-fitted in suitable positions of the individual press-fitting slits 16*e*: and the electric wires 15 are individually fitted in the paired upper and lower electric wire fitting grooves 16*b* and 16*d* having the compression relay terminals 17 press-fitted therein, so that the upper and lower electric wires 15 are individually compressed and connected in the upper and lower compression blades 17*a* and 17*b* of the compression relay terminals 17 so that the upper and lower electric wires 15 of the insulating plate 16 can be electrically connected.

4 Claims, 9 Drawing Sheets

CONNECTION STRUCTURE FOR ELECTRIC WIRES

BACKGROUND OF THE INVENTION

The present invention relates to a connection structure for electric wires to be accomodated in an electric connection box.

The electric connection box to be used for branching and connecting a wire harness or the like for an automobile with a variety of electrical equipments branches and connects the electric wires rationally and economically by concentrating a branching and connecting point at one point. A variety of types have been developed for different kinds and applications of automobiles as the wire harness grows dense.

One of the aforementioned electric connection boxes is manufactured, as shown in FIG. 9, by punching a hoop material 6 into individual bus bars 7A to 7C by a press mold, by cutting and raising tab terminals 7*a* and 7*b* vertically from the pattern portion of each of the bus bars 7A to 7C, by stacking insulating plates 8A to 8C individually between the bus bars 7A to 7C, and by housing the stack in an upper case 9A and a lower case 9B of an electric connection box 9. Here, numeral 10 designates relay terminals, and numerals 11 and 12 designate relays and fuses.

However, the wiring of each of the aforementioned bus bars 7A to 7C has to be complicated by folding or bending it according to the conveniences of the circuit construction. The circuit design takes a long time, and the number of designing steps increases. When only one circuit is to be changed, the wiring of another circuit has to be reconsidered to raise another problem that a quick response to the design change cannot be made.

SUMMARY OF THE INVENTION

The present invention has been conceived for solving the aforementioned problems of the prior art and has an object to provide an electric wire connection structure which can reduce the number of steps of designing a circuit drastically and can respond to a design change quickly.

In order to solve the aforementioned problems, according to the present invention, there is provided a connection structure for electric wires to be accomodated in an electric connection box, characterized: in that an insulating plate has a pair of upper and lower electric wire fitting grooves formed straight in its upper face and lower face at vertically symmetric positions such that the paired upper and lower electric wire fitting grooves are provided in plurality at a constant pitch in the widthwise direction thereof; in that press-fitting slits are formed to extend through the paired upper and lower electric wire fitting grooves and are provided in plurality at a constant pitch in the longitudinal direction of the paired upper and lower electric wire fitting grooves; in that compression relay terminals having compression blades formed at their upper and lower portions are press-fitted into suitable portions of the individual press-fitting slits; and in that the electric wires are individually fitted in the paired upper and lower electric wire fitting grooves, in which the compression relay terminals are press-fitted, so that the upper and lower electric wires are individually compressed and connected by the upper and lower compression blades of the compression relay terminals.

According to the present invention, the common insulating plate is prepared such that the paired upper and lower electric wire fitting grooves are formed straight in the plurality in the insulating plate at the constant pitch in the transverse direction, and such that the press-fitting slits are formed in the plurality in the individual electric wire fitting grooves at the constant pitch in the longitudinal direction; the compression relay terminals are press-fitted in suitable positions of the individual press-fitting slits: and the electric wires are individually fitted in the paired upper and lower electric wire fitting grooves having the compression relay terminals press-fitted therein. As a result, the upper and lower electric wires are individually compressed and connected in the upper and lower compression blades of the compression relay terminals so that the upper and lower electric wires of the insulating plate can be electrically connected.

If the construction is made such that a jumper terminal having a plurality of compression blades formed in a crosswise direction across the pitch of the electric wire fitting grooves is press-fitted in the press-fitting slits of the electric wire fitting grooves in each face of said insulating plate such that its individual compression blades are compressed and connected with the individual electric wires, as in Aspect 2, or if the construction is made such that a jumper wire is compressed and connected with the compression blades of the individual relay terminals which are press-fitted in the press-fitting slits of the electric wire fitting grooves in each face of said insulating plate, as in Aspect 3, the electric wires in the crosswise direction in each face of the insulating plate can be electrically connected by the jumper terminal or the jumper wire.

If the construction is made such that an input/output terminal having a compression blade formed is press-fitted in the press-fitting slit of the electric wire fitting groove in each face of said insulating plate so that its compression blade is compressed and connected with the electric wire, as in Aspect 4, the input/output terminal can be disposed at the position of the press-fitting slit.

DETAILED DESCRIPTION OF THE PREFERRED EMBODIMENTS

Figure 1:
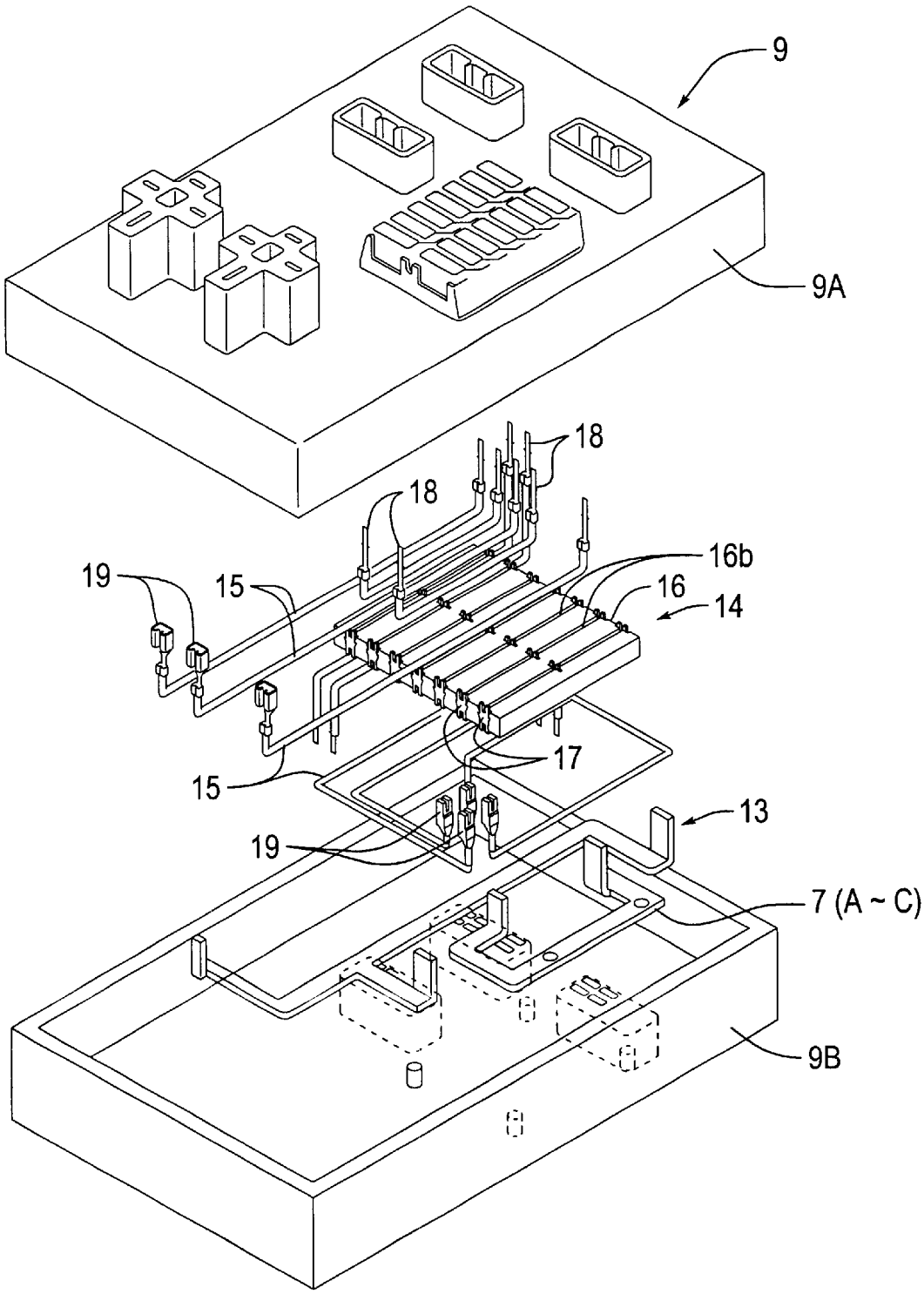
FIG. 1 is a perspective view of a connection structure of electric wires in an electric connection box of the present invention.

Embodiments of the present invention will be described in detail with reference to the accompanying drawings. Here, the detail description of the same construction and functions as those of the prior art will be omitted by designating them by the common reference numerals.

Figure 2:
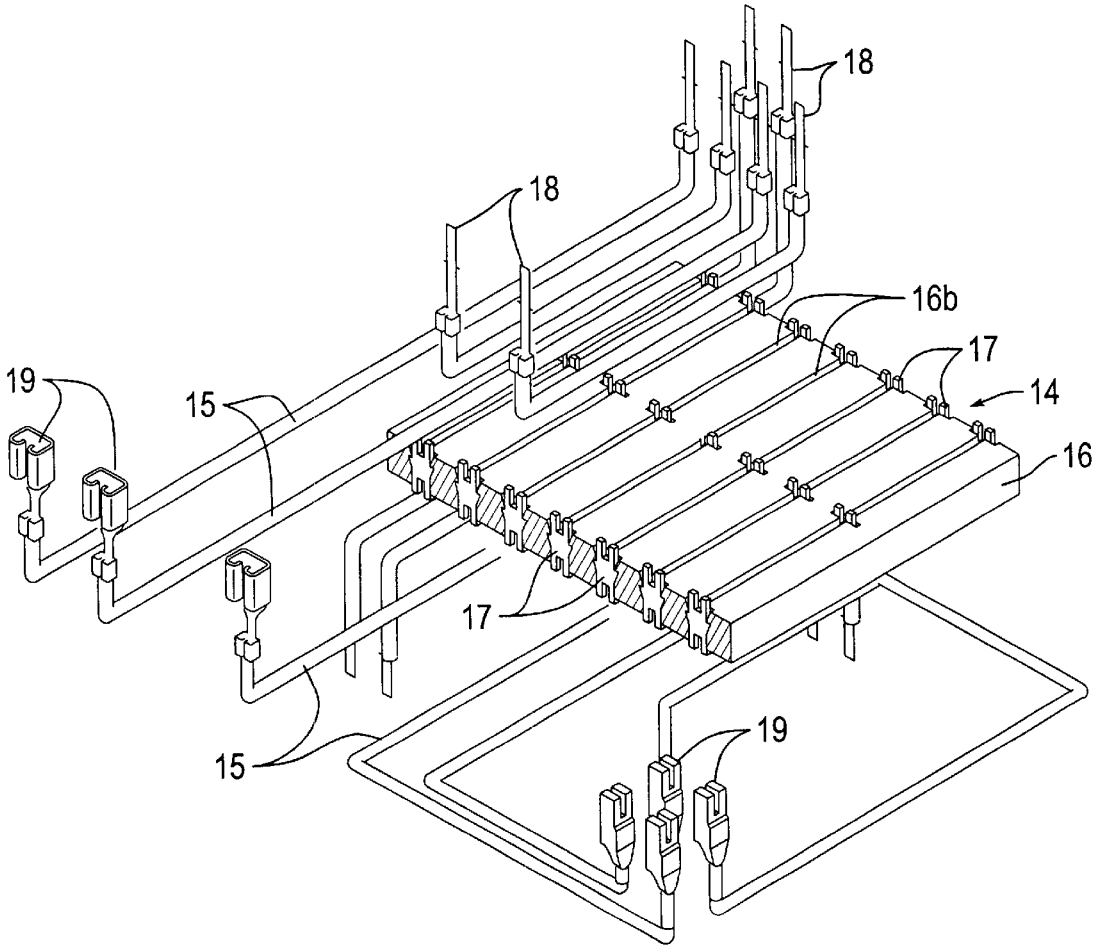
FIG. 2 is an enlarged view of the connection structure of the electric wires of FIG. 1.

In an upper case 9A and a lower case 9B of an electric connection box 9, as shown in FIGS. 1 and 2, there is accomodated a block 14 in which a signal portion and a low current region are wired by electric wires 15, separately of a block 13 in which a high current region is wired by bus bars 7(A to C).

Figure 3A:
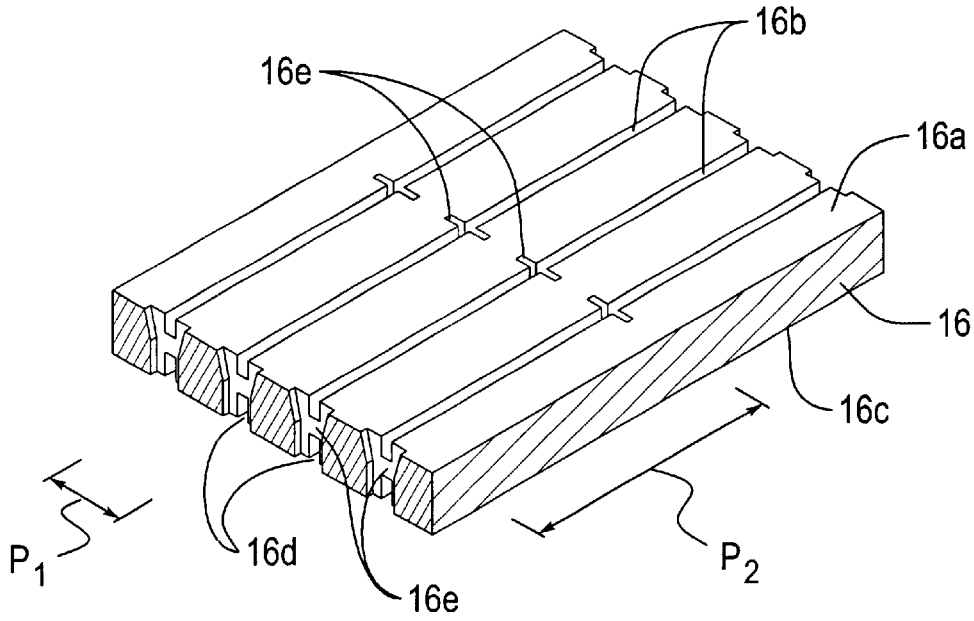
FIG. 3A is a perspective view of an insulating plate.
Figure 3B:
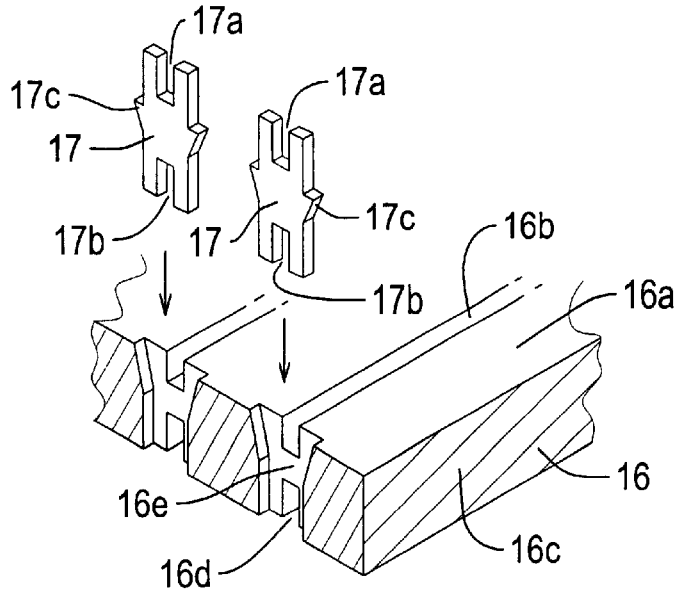
FIG. 3B is an enlarged view of FIG. 3A.

In vertically symmetric positions of the upper face 16*a* and the lower face 16*c* of an insulating plate 16 of the aforementioned block 14, as shown in detail in FIG. 3, there are formed straight a pair of upper and lower electric wire fitting grooves 16*b* and 16*d*.

These paired upper and lower electric wire fitting grooves 16*b* and 16*d* are provided in plurality at a constant pitch P1 in their transverse direction.

On the other hand, there are formed press-fitting slits 16*e* which extend through the paired upper and lower electric wire fitting grooves 16*b* and 16*d*. These press-fitting slits 16*e* are formed in plurality at a constant pitch P2 in the longitudinal direction of the paired upper and lower electric wire fitting grooves 16*b* and 16*d*.

The aforementioned insulating plate 16 is prefabricated and standardized to the maximum number and the largest length of the electric wire fitting grooves 16*b* and 16*d* and is cut out for use from the standardized one in accordance with the necessary number and length of the electric wire fitting grooves 16*b* and 16*d*.

On the other hand, there are provided a compression relay terminal 17 which is provided compression blades 17*a* and 17*b* at its upper and lower portions. This compression relay terminal 17 is press-fitted downward into the electric wire fitting grooves 16*b* and 16*d* of the aforementioned insulating plate 16. At the two side portions of the compression relay terminal 17, individually, there are formed retained pawls 17*c* which are to be retained on the two side portions of the press-fitting slits 16*e* thereby to prevent the compression relay terminal 17 from coming out.

Figure 4A:
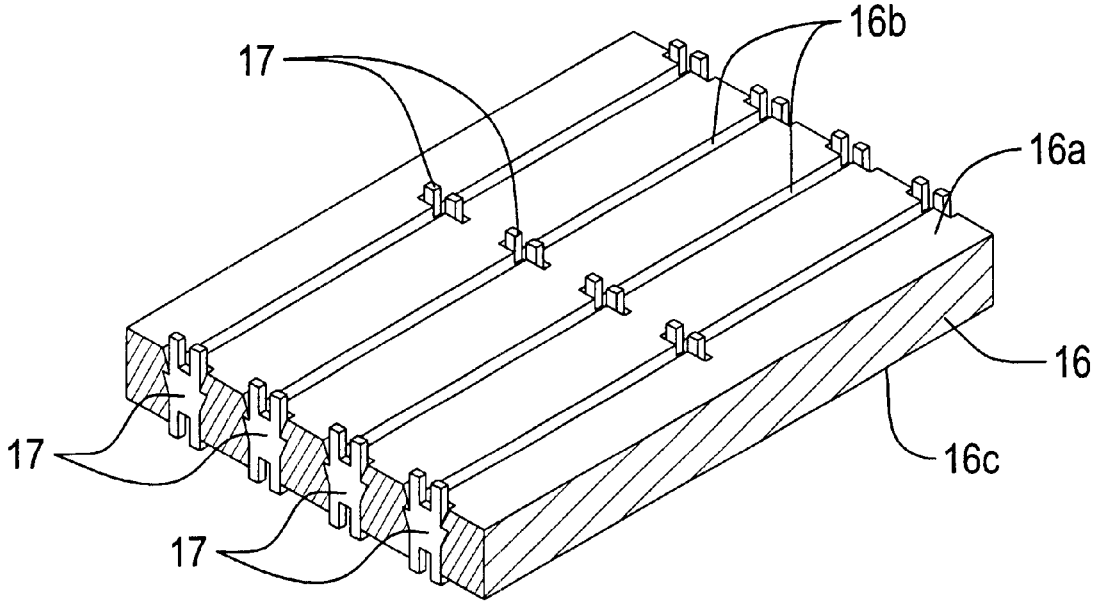
FIG. 4A is a perspective view of the insulating plate having compression relay terminals press-fitted therein.
Figure 4B:
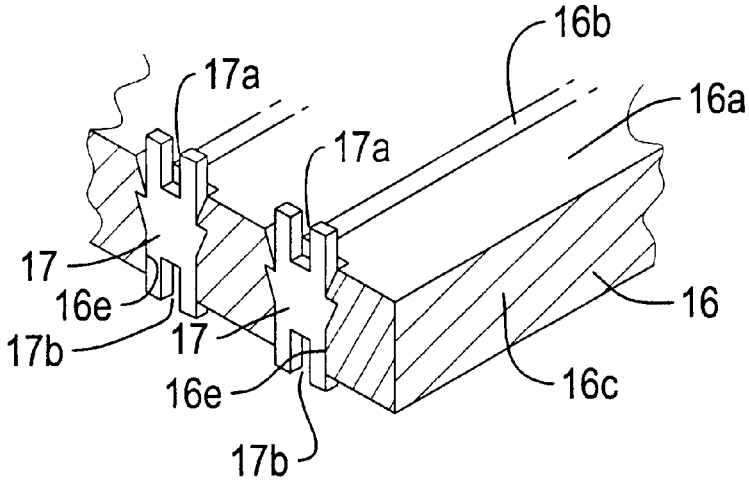
FIG. 4B is an enlarged view of FIG. 4A.

The aforementioned compression relay terminals 17 are press-fitted in the suitable ones of the press-fitted slits 16*e* which are required for the circuit construction by the electric wires 15, as shown in FIG. 4.

Figure 5A:
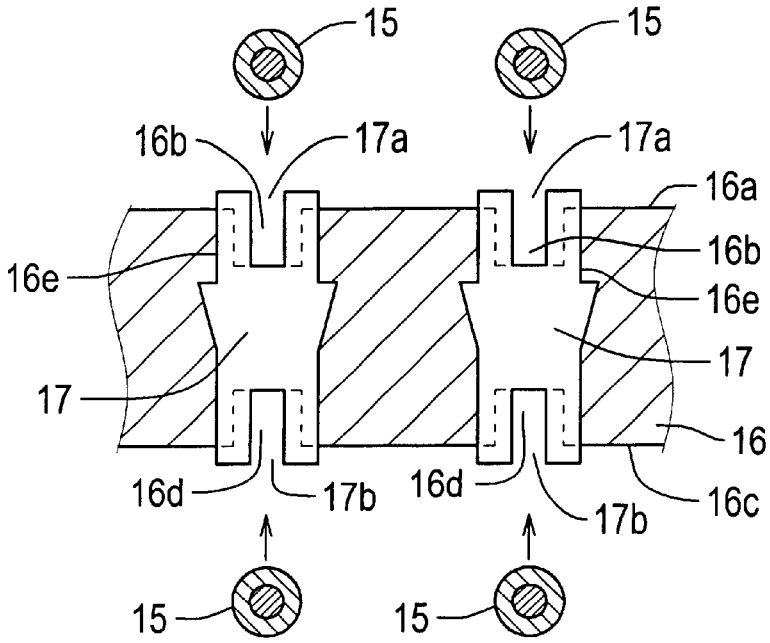
FIG. 5A is a sectional view of the insulating plate before the electric wires are compressed in the compression relay terminals.
Figure 5B:
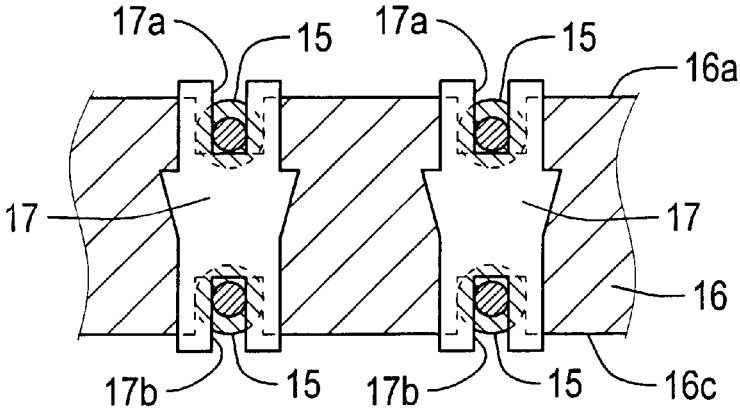
FIG. 5B is a sectional view after the electric wires are compressed in the compression relay terminals.

As shown in FIG. 5, morever, the upper and lower electric wires 15 are individually inserted into the paired upper and lower electric wire fitting grooves 16*b* and 16*d* having the press-filled compression relay terminals 17 so that they are individually compressed and connected by the upper and lower compression blades 17*a* and 17*b* of the compression relay terminals 17.

As shown in FIGS. 1 and 2, the electric wires 15 to be inserted into the individual electric wire fitting grooves 16*b* and 16*d* of the aforementioned insulating plate 16 are given different lengths, and a male terminal 18 and a female terminal 19 for external input/output are individually attached to the two ends of each electric wire 15. Moreover, the male terminal 18 and the female terminal 19 can be disposed at arbitrary positions according to the length of the electric wire 15 by raising 18 and 19 individually.

In the aforementioned construction: the paired upper and lower electric wire fitting grooves 16*b* and 16*d* are formed straight in the insulating plate 16 at the constant pitch P1 in the transverse direction; the press-fitting slits 16*e* are formed in the individual electric wire fitting grooves 16*b* and 16*d* at the constant pitch P2 in the longitudinal direction; the compression relay terminals 17 are press-fitted in suitable positions of the individual press-fitting slits 16*e*: and the electric wires 15 are individually fitted in the paired upper and lower electric wire fitting grooves 16*b* and 16*d* having the compression relay terminals 17 press-fitted therein. As a result, the upper and lower electric wires 15 are individually compressed and connected in the upper and lower compression blades 17*a* and 17*b* of the compression relay terminals 17 so that the upper and lower electric wires 15 of the insulating plate 16 can be electrically connected.

Thus, the insulating plate 16 can be cut out for use according to the numbers and lengths of the necessary electric wire fitting grooves 16*b* and 16*d* in accordance with the different electric connection boxes 9 for different kinds and grades of automobiles so that it can be made common (or standardized) to reduce the fabrication cost of the insulating plate 16.

On the other hand, the electric wires 15 to be fitted in the electric wire fitting grooves 16*b* and 16*d* of the insulating plate 16 are given different lengths so that the external input/output terminals 18 and 19 at the two ends of the electric wires 15 can be disposed at arbitrary positions. At the same time, the upper and lower electric wires 15 are compressed and connected by the upper and lower compression blades 17*a* and 17*b* of the compression relay terminals 17 which are press-fitted in suitable positions of the press-fitting slits 16*e*, so that they can be electrically connected in the insulating plate 16. As a result, the number of steps of designing the circuit can be drastically reduced, and a slight change in the circuit can be made merely by changing the lengths of the electric wires 15 and the positions of the compression relay terminals 17 thereby to respond the design change promptly.

Especially in the electric connection box 9, the high current region is given a wiring structure similar to that of the bus bars 7(A to C) of the prior art, and the signal portion and the low current region are given the aforementioned wiring structure by the electric wires 15. The external input/output terminals 18 and 19 can be disposed at the arbitrary positions to make the arrangement of the insulating plate 16 flexible in the electric connection box 9 and the arranging design feasible.

Figure 6A:
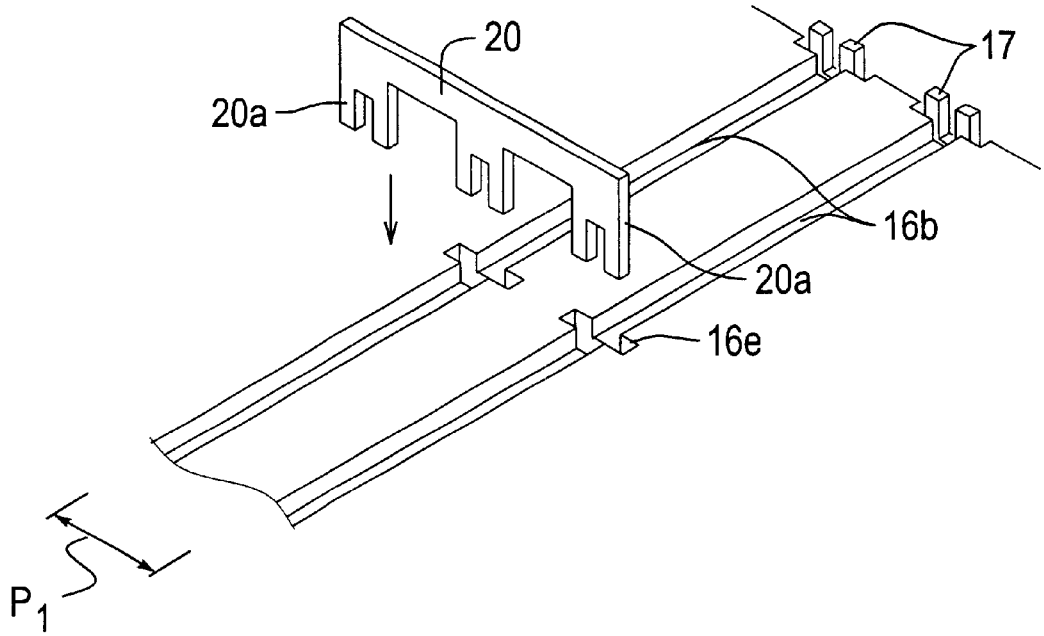
FIG. 6A is a perspective view of a jumper terminal.
Figure 6B:
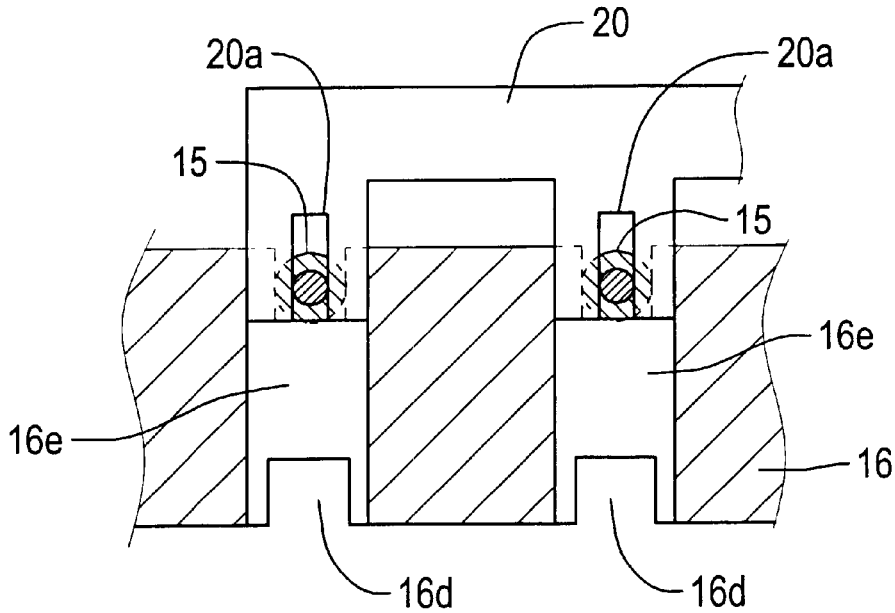
FIG. 6B is a sectional view of the insulating plate when the jumper terminal is compressed on the electric wires.

As shown in FIG. 6, a jumper terminal 20 having a plurality of compression blades 20*a* formed in the crosswise direction across the pitch P1 of the electric wire fitting grooves 16*b* and 16*d* of the aforementioned insulating plate 16, and the individual compression blades 20*a* of the jumper terminal 20 are press-fitted in the press-fitting slits 16*e* of the electric wire fitting grooves 16*b* and 16*d* in the individual faces 16*a* and 16*c* of the insulating plate 16. Then, the individual compression blades 20*a* are compressed and connected with the individual electric wires 15.

By the jumper terminal 20, therefore, the crosswise electric wires 15 in the individual faces 16*a* and 16*c* of the insulating plate 16 can be electrically connected so that the compression relay terminals 17 can be made smaller and lighter than those of the case, in which the crosswise electric wires are connected by forming the compression blades on the left and right sides of the compression relay terminals 17, thereby to narrower the electric wire pitch P1.

Figure 7A:
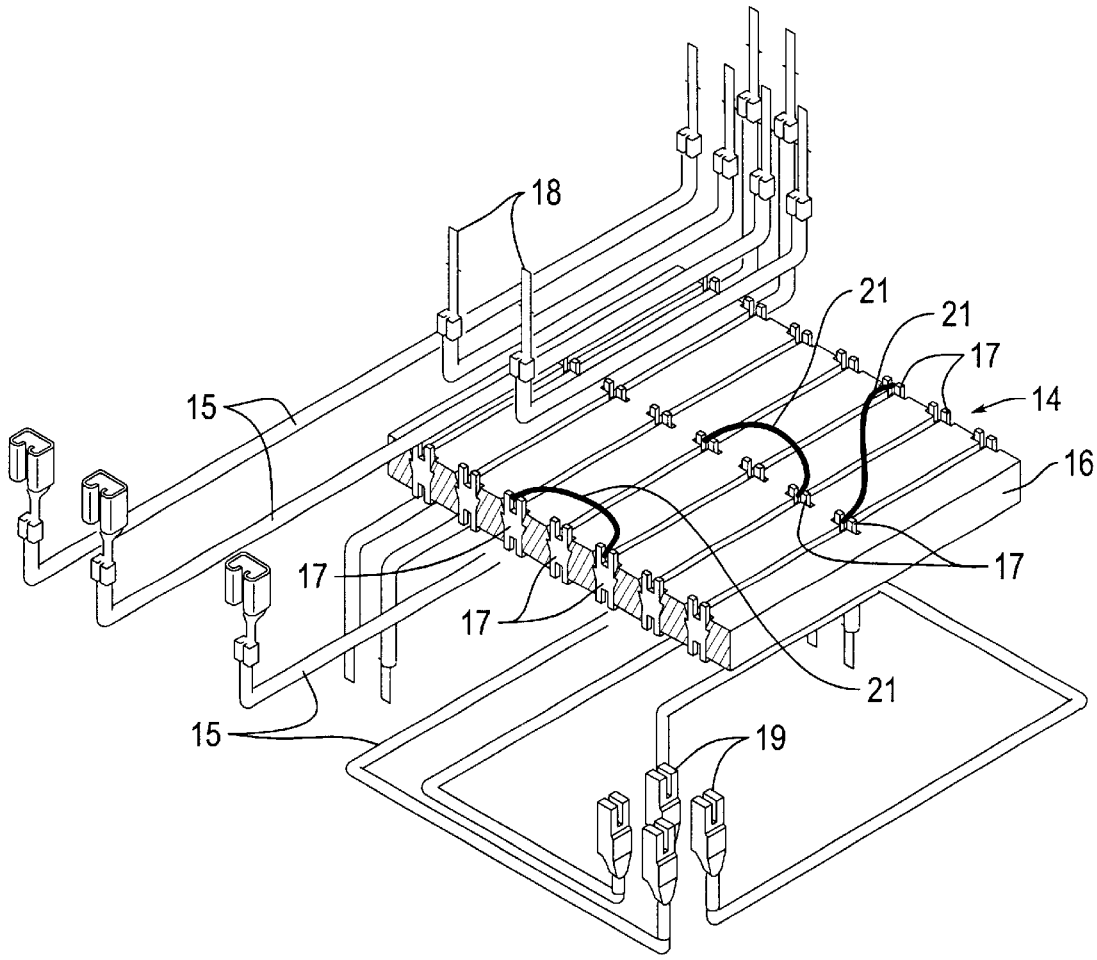
FIG. 7A is a perspective view of a connection structure of electric wire, in which jumper wires are compressed in the compression relay terminals.
Figure 7B:
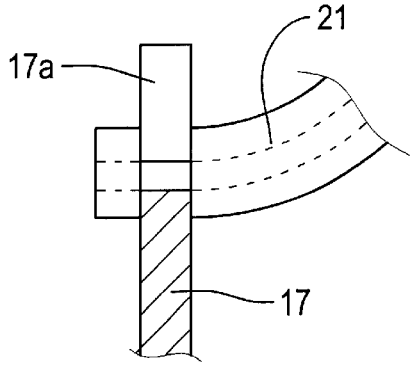
FIG. 7B is a sectional side elevation of a compression relay terminal compressing the jumper wire.

As shown in FIG. 7, on the other hand, short jumper wires (electric wires) 21 are provided and are compressed and connected at their two ends with the compression blades 17*a* and 17*b* of the individual compression relay terminals 17 which are press-fitted in the press-fitting slits 16*e* of the electric wire fitting grooves 16*b* and 16*d* in the individual faces 16*a* and 16*c* of the insulating plate 16. As in FIG. 6, too, the crosswise electric wires 15 in the individual faces 16*a* and 16*c* of the insulating plate 16 can be connected.

Figure 8A:
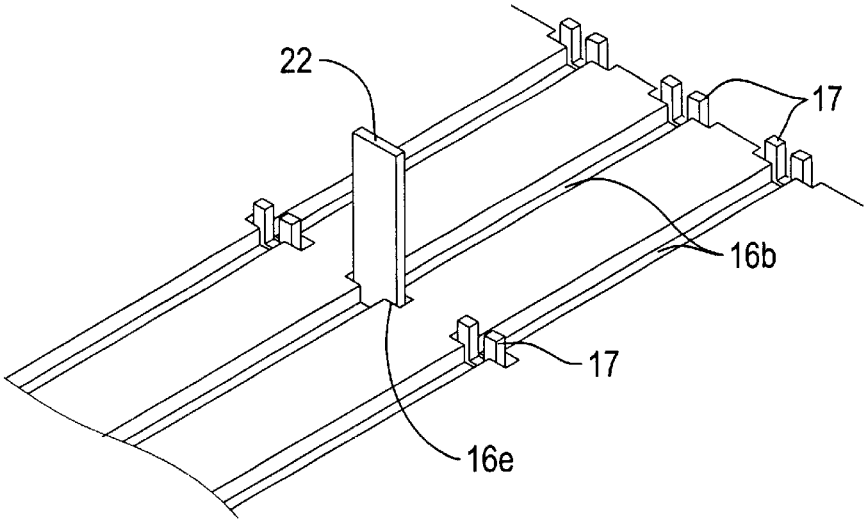
FIG. 8A is a perspective view of a male terminal.
Figure 8B:
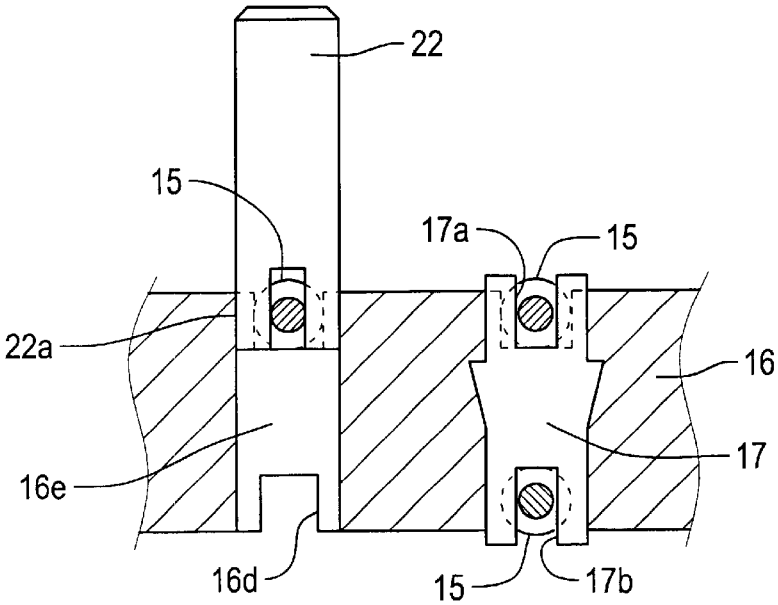
FIG. 8B is a sectional view of the male terminal compressing the electric wire.
Figure 9:
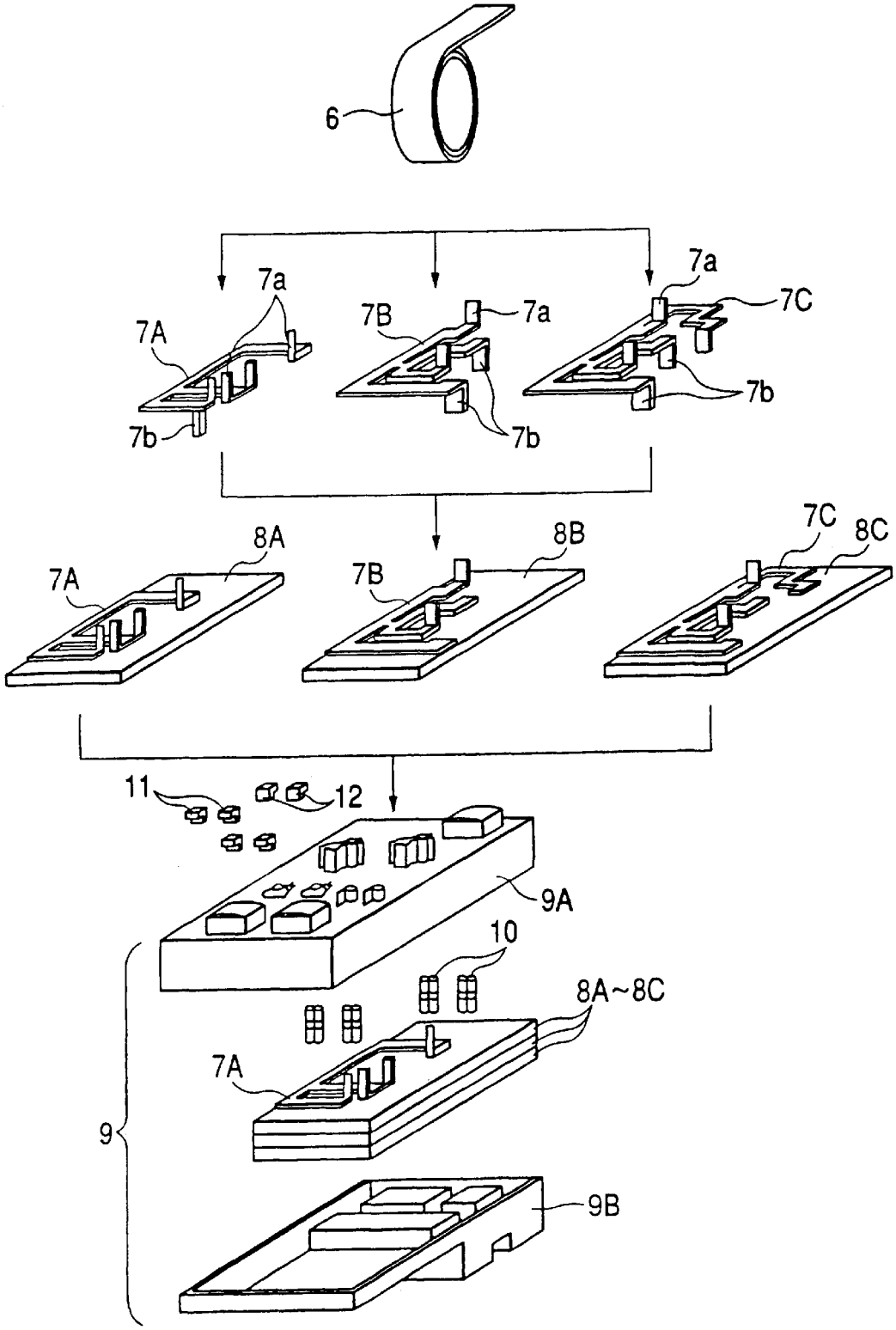
Fig. 9 PRIOR ART
FIG. 9 is a perspective view of a process of the prior art for manufacturing bus bars.

As shown in FIG. 8, moreover, an input/output male terminal 22 having a compressed blade 22*a* formed at its lower portion is provided and is press-fitted at its compression blade 22*a* in the press-fitting slit 16*e* of the electric wire fitting groove 16*b* or 16*d* in each face 16*a* or 16*c* of the insulating plate 16. Then, the compression blade 22*a* is compressed and connected with the electric wire 15. Thus, the male terminal 22 can be disposed at the position of the press-fitting slit 16*e*.

According to the present invention, as apparent from the foregoing description: the common insulating plate is prepared such that the paired upper and lower electric wire fitting grooves are formed straight in the plurality in the insulating plate at the constant pitch in the transverse direction, and such that the press-fitting slits are formed in the plurality in the individual electric wire fitting grooves at the constant pitch in the longitudinal direction; the compression relay terminals are press-fitted in suitable positions of the individual press-fitting slits: and the electric wires are individually fitted in the paired upper and lower electric wire fitting grooves having the compression relay terminals press-fitted therein. As a result, the upper and lower electric wires are individually compressed and connected in the upper and lower compression blades of the compression relay terminals so that the upper and lower electric wires of the insulating plate can be electrically connected.

Thus, the insulating plate can be cut out for use according to the numbers and lengths of the necessary electric wire fitting grooves in accordance with the different electric connection boxes for different kinds and grades of automobiles so that it can be made common (or standardized) to reduce the fabrication cost.

On the other hand, the electric wires to be fitted in the electric wire fitting grooves of the insulating plate are given different lengths so that the external input/output terminals at the two ends of the electric wires can be disposed at arbitrary positions. At the same time, the upper and lower electric wires are compressed and connected by the upper and lower compression blades of the compression relay terminals which are press-fitted in suitable positions of the press-fitting slits, so that they can be electrically connected in the insulating plate. As a result, the number of steps of designing the circuit can be drastically reduced, and a slight change in the circuit can be made merely by changing the positions of the compression relay terminals thereby to respond the design change promptly.

Especially in the electric connection box, the high current region is given a wiring structure similar to that of the bus bars of the prior art, and the signal portion and the low current region are given the aforementioned wiring structure by the electric wires. The external input/output terminals can be disposed at the arbitrary positions to make the arrangement of the insulating plate flexible in the electric connection box and the arranging design feasible.

If the construction is made such that the jumper terminal is press-fitted in the press-fitting slits to compress and connect its compression blade on the electric wires, as in Aspect 2, or such that the jumper wire is compressed and connected in the compression blades of the compression relay terminals press-fitted in the press-fitting slits, as in Aspect 3, the crosswise electric wires can be electrically connected in the individual faces of the insulating plate by the jumper terminal or the jumper wire.

As a result, the compression relay terminals can be made smaller and lighter than those of the case, in which the crosswise electric wires are connected by forming the compression blades on the left and right sides of the compression relay terminals, thereby to narrower the electric wire pitch.

If the input/output terminals are press-fitted in the press-fitting slits and are compressed and connected at their compression blades with the electric wires, as in Aspect 4, the input/output terminals can be disposed at the positions of the press-fitting slits.

What is claimed is:

1. A connection structure including electric wires to be accommodated in an electric connection box, wherein:

an standardized insulating plate includes a pair of upper and lower electric wire fitting grooves formed straight in an upper face and lower face thereof at vertically symmetric positions such that the paired upper and lower electric wire fitting grooves are provided in plurality at a constant pitch in a widthwise direction thereof, and press-fitting slits are formed on the standardized insulating plate to extend through the paired upper and lower electric wire fitting grooves, the press-fitting slits provided in plurality at a constant pitch in a longitudinal direction of the paired upper and lower electric wire fitting grooves;

compression relay terminals having compression blades formed at their upper and lower portions and retaining pawls that gradually extend outwardly at an intermediate position are press-fitted downwardly into press-fitting slits so that ends of the upper and lower compression blades of the terminals extend passed the upper and lower face of the insulation plate respectively; and electric wires with at least one of a male and female terminal connected to ends of the electric wires, the ends being free from the insulating plate, the electric wires are individually fitted in the paired upper and lower electric wire fitting grooves, in which said compression relay terminals are press-fitted, so that upper and lower electric wires are individually compressed and connected by the upper and lower compression blades of said compression relay terminals.

2. The electric wire connection structure as set forth in claim 1, wherein a jumper terminal having a plurality of compression blades formed in a crosswise direction across the pitch of wire electric wire fitting grooves is press-fitted in the press-fitting slits of the electric wire fitting grooves in each face of said insulating plate such that individual compression blades thereof are compressed and connected with individual electric wires.

3. The electric wire connection structure as set forth in claim 1, wherein a jumper wire is compressed and connected with the compression blades of the individual relay terminals which are press-fitted in the press-fitting slits of the electric wire fitting grooves in each face of said insulating plate.

4. The electric wire connection structure as set forth in claim 1, wherein an input/output terminal having a compression blade formed is press-fitted in the press-fitting slit of the electric wire fitting groove in each face of said insulating plate so that compression blade thereof is compressed and connected with said electric wire.

* * * * *